US005638995A

United States Patent [19]

Mazda

[11] Patent Number: 5,638,995

[45] Date of Patent: Jun. 17, 1997

[54] BELLOWS CONTAINER

[76] Inventor: Masayosi Mazda, 3-70 Ohno-Cho, Kakamihara, Gifu 504, Japan

[21] Appl. No.: 336,281

[22] Filed: Nov. 8, 1994

[51] Int. Cl.[6] ..... B65D 37/00

[52] U.S. Cl. ..... 222/215

[58] Field of Search ..... 222/92, 107, 206, 222/212, 215

[56] References Cited

U.S. PATENT DOCUMENTS

| | | | |
|---|---|---|---|
| 29,699 | 8/1860 | Isaacsen | 222/215 X |
| 3,174,655 | 3/1965 | Hurschman | 222/215 |
| 3,201,111 | 8/1965 | Afton | 222/215 X |
| 3,340,869 | 9/1967 | Bane | 222/215 X |
| 3,390,821 | 7/1968 | Mullan | 222/215 X |
| 3,473,524 | 10/1969 | Drewe | 222/215 X |
| 3,506,163 | 4/1970 | Rauh et al. | 222/215 X |
| 3,629,939 | 12/1971 | Maltenfort | 222/215 X |
| 5,320,256 | 6/1994 | Wood | 222/215 X |
| 5,333,761 | 8/1994 | Davis et al. | 222/212 |

OTHER PUBLICATIONS

Japanese Utility Model Laying–Open Publication No. 60–169143 (1985).

Japanese Utility Model Laying–Open Publication No. 56–100347 (1981).

Japanese Utility Model Laying–Open Publication No. 4–7478 (1992).

Japanese Utility Model Laying–Open Publication No. 59–168350 (1984).

Japanese Utility Model Laying–Open Publication No. 59–174474 (1984).

*Primary Examiner*—Andres Kashnikow
*Assistant Examiner*—Kenneth Bomberg
*Attorney, Agent, or Firm*—Mallinckrodt & Mallinckrodt

[57] ABSTRACT

A contractible plastic bellows container is disclosed, which can be made in a single molding process and is capable of discharging practically all the viscous fluid content. A plastic bellows container of the invention comprises a neck portion with an opening, a top shoulder section, a bottom shoulder section, and a bottom protrusion. The bottom shoulder section and the bottom protrusion are reversible. When the plastic bellows container is fully contracted, the space created therein by the overlapping bellows can be substantially eliminated by the reversed bottom protrusion entering inside of the neck portion and the reversed bottom shoulder section. The bellows container may advantageously be used with an airtight discharging means.

14 Claims, 8 Drawing Sheets

BELLOWS CONTAINER

BACKGROUND OF THE INVENTION

1. Field of the Invention

This invention generally relates to a plastic bellows container for a viscous fluid. More particularly, this invention relates to a plastic bellows container that can substantially completely discharge the viscous fluid contained in the bellows container.

2. Description of the Prior Art

Plastic bellowslike or bellows containers for various uses are conventionally made by a blow molding means into various configurations and sizes. Such plastic bellows containers can be produced rather cheaply such that plastic bellows containers are usually disposed of after a single use.

Most conventional plastic bellows containers are contracted vertically along their axis to discharge the viscous fluid content. Bellows are provided along the side wall of containers such that the bellows "close" when the plastic containers are contracted along the vertical axis of the containers and usually "open" back when the contracting forces no longer apply.

When a plastic bellows container is molded by means of blowing a plastic material ("blow molding"), the farther away the portions of the bellows of the container are from its central vertical axis, the thinner they are made. Thus, the outermost portions or ridges of the side bellows are formed the thinnest and the innermost portions or ridges of the side bellows are formed the thickest. Therefore, when such a plastic bellows container is contracted to the fullest in an attempt to push out "all" the viscous fluid content, the "overlapping" thick innermost portions or ridges of the side bellows create "space" or "void" along the axis of the bellows container, keeping the top portion of the plastic bellows container from contacting the bottom portion of the bellows container. Thus the viscous fluid content of the plastic bellows container in the void cannot be discharged to the last portion. Such space or void in the bellows container unavoidably holds a portion of the fluid content. The plastic bellows container with a remainder of the viscous fluid content is usually disposed of together with the plastic container as trash, which is waste of the content and uneconomical.

Here, the terms "space" and "void", which will be generally replaced by the term "dead space" hereinafter, generally mean the space or void created by the overlapping (innermost ridges of) bellows of a bellows container when the bellows container without any fluid content is "fully" contracted along its axis.

There have been introduced a number of plastic bellows containers in an attempt to discharge the viscous fluid contents in the bellows containers to a maximum degree. Japanese Utility Model Laying-Open Publication No. 4-7478(1992) (filed Jan. 23, 1992 in the name of Dai-Nippon Printing Co., Ltd. ) discloses a plastic bellows container having a bottom plate with an inner protrusion which protrudes into the container such that the protrusion enters the "otherwise (without the protrusion)" created dead space in the bellows container when the bellows container is fully contracted and helps discharge the viscous fluid content from the "dead space".

It requires an additional manufacturing step to mount such a bottom plate having an inner protrusion as disclosed in said Publication No. 4-7478 onto a bellows container since the bottom plate with the protrusion cannot possibly be formed together with the rest of the plastic bellows container in a single blow molding process, thus unavoidably and considerably pushing up the manufacturing cost. Further, the inner protrusion on the bottom plate much decreases the total capacity of the bellows container, which is a considerable drawback.

Japanese Utility Model Laying-Open Publication No. 59-168350(1984) (filed Apr. 28, 1983 in the name of Kureha Chemical Industries Co., Ltd. and Kureha Plastics Co., Ltd.) discloses a plastic bellows container with an inwardly rising or depressed bottom such that the rising bottom enters such otherwise created "dead space" as well as the neck portion of the bellows container when the bellows container is fully contracted, helping discharge the viscous fluid content in the otherwise created dead space and even in the neck portion of the bellows container.

Japanese Utility Model Laying-Open Publication No. 59-174474(1984) (filed Mar. 16, 1983 in the name of Corpo Co., Ltd.) discloses a plastic bellows container whose bottom is depressed to the inside of the bellows container. The configuration of the depressed bottom substantially corresponds to that of the "dead space" otherwise made in the bellows container such that the "dead space" may be eliminated by the depression and the viscous fluid content in the otherwise created "dead space" of the bellows container is discharged or pushed out when the bellows container is fully contracted.

Japanese Utility Model Laying-Open Publication No. 60-169143(1985) (filed Apr. 19, 1984 in the name of Haruyasu Takamizawa et al.) discloses a plastic bellows container the bottom of which is depressed into the bellows container so that the depression enters the otherwise generated "dead space" and the neck portion of the bellows container when the bellows container is fully contracted, pushing the viscous fluid out of the "dead space" and the neck portion of the bellows container to a maximum degree.

These plastic bellows containers disclosed in said Publication Nos. 59-168350, 59-174474 and 60-169143 are all moldable in a single blow molding process. However, if the bottoms of these containers are to be made rigid or thick enough so that the protrusions or depressions may function as designed, the bellows side walls of the bellows containers become excessively rigid or thick. Such excessively rigid or thick bellows side walls make it hard for users to contract the containers conveniently. In addition, when the bellows side walls are made "too" rigid or thick, void or "dead space" to be created in those bellows containers by the thick overlapping bellows, when the bellows containers are fully contracted, unavoidably become "too" large, requiring to make the size of such protrusions or depressions correspondingly larger to fill the increased "dead space". Then the inside utilizable volume or capacity of such bellows containers is destined to decrease correspondingly because of such protrusions or depressions, which is a contradiction and a considerable drawback.

On the other hand, if it is attempted to make it easy or convenient for users to contract or use the bellows containers, and if it is attempted to make such "dead space" smaller, by molding the bellows side walls thin enough, then the bottoms of the plastic bellows containers will be made too thin or soft, thus the protrusions or depressions of the plastic bellows containers will not function properly or as desired since such thin protrusions or depressions will be easily deformed by the pressure from the viscous fluid content.

In addition, in order to eliminate "dead space" as completely as possible, such protrusions or depressions are usually made horizontally wide. When a plastic bellows container with a wide protrusion or depression on the bottom is to be charged with a highly viscous fluid, the wide protrusion or depression on the bottom of the bellows container often obstructs complete filling of the bellows container with the viscous fluid as the upper edge of the wide protrusion or depression is too close to the innermost ridges of the bellows around the bottom, and the gap between the upper edge of the protrusion or depression and the innermost ridges of the bottom bellows is too narrow, preventing the air trapped between the side wall of the protrusion or depression and the side wall of the bellows container from effectively escaping.

In order to solve those problems considerably, it is required to prepare very complicated and very well designed (thus expensive) molds and to use "higher skills". The manufacturing processes will be more complicated as well and thus the productivity will be much deteriorated. The resulting products or plastic bellows containers will become unavoidably much more expensive, which is a great disadvantage.

Japanese Utility Model Laying-Open Publication No. 56-100347(1981) (filed Dec. 28, 1979 in the name of Diesel Machines Co. Ltd.) discloses a plastic bellows container with an inner depressed bottom, whose bellows side wall is tapered such that the bellows do not "squarely" overlap one on another, or the innermost ridges of the bellows do not vertically overlap one on another. The tapered bellows side wall helps make "dead space" considerably smaller in the bellows container when the bellows container is fully contracted. The round shaped depression provided on the bottom of this bellows container partially fills the "dead space" which is created in the bellows container anyway.

The tapered plastic bellows container disclosed in said Publication No. 56-100347 certainly makes such "dead space" smaller, and the round depression on the bottom will partially eliminate the space made inside the container, however, even this bellows container cannot totally eliminate dead space, and the dead space in the neck portion of this bellows container remains unattended. And the drawbacks set forth earlier remain unsolved with this plastic bellows container.

Accordingly, it is an object of the present invention to provide a "cheap" plastic bellows container which can easily push out substantially all the viscous fluid content in the bellows container.

It is another object of the present invention to provide a cheap plastic bellows container capable of easily discharging substantially all the viscous fluid content and still easily and completely filling out even with a highly viscous fluid.

It is still another object of the present invention to provide a cheap plastic bellows container capable of easily discharging substantially all the viscous fluid content and still providing a "large" capacity.

It is another object of the present invention to provide cheap plastic bellows containers of various configurations, including bellows containers with a single bellows, which are capable of discharging substantially all the viscous fluid content.

It is a further object of the present invention to provide a cheap plastic bellows container that can keep the content fresh and without deterioration by air and contamination.

SUMMARY OF THE INVENTION

The present invention provides various types and designs of plastic bellowslike or bellows containers for viscous fluid. Bellows containers of the present invention will contain a viscous fluid such as a fluid food, cosmetic product, detergent, chemical, grease, ointment, and other pharmaceutical product or oil.

Bellows containers of the present invention may be used to contain practically any fluid, including highly viscous fluids for use industrially or domestically. Plastic bellows containers according to the present invention are economical in that it can be made cheaply for all the special features and can discharge or push out substantially all the viscous fluid contained in the bellows container, not wasting the viscous fluid content.

A plastic bellows container according to the present invention is a single unit plastic container produced in a single blow molding process. The blow molding means may be a direct blow molding in which a heated plastic material is placed in a mold and air is blown into the plastic material and the mold. The blow molding may be a protrusion blow molding, cold injection molding, or injection blow molding. Any other suitable conventional molding means may also be utilized.

A plastic bellows container of the present invention comprises bellows formed along its side wall such that when contracted vertically or along its axis the plastic bellows container "shrinks" vertically or along its axis, and keeps "shrunk" when provided with a valve means that prevents air inflow.

A plastic bellows container of the present invention may comprise only one large bellows along its side wall. This bellows container has an appearance of a "flying saucer". The plastic bellows container is provided with a top protrusion or neck portion having an opening through which a viscous fluid is charged and discharged, and a reversible bottom protrusion which protrudes outside the bottom of the bellows container. The reversed configuration of the bottom protrusion or the configuration of the bottom protrusion when the bottom protrusion is pushed inside the bellows container or reversed corresponds to the inside configuration of the top protrusion or neck portion. The bellows container also has a top shoulder section and a bottom "shoulder" section. The bottom shoulder section is made reversible.

When the bellows container is fully contracted, the reversed bottom protrusion and the reversed bottom shoulder section fill the "dead space" inside the fully contracted bellows container and the space in the top neck portion as well and push out substantially all the viscous fluid content therefrom.

Another plastic bellows container according to the present invention comprises three large bellows of different sizes provided along its side wall, the top bellows being the largest horizontally and the bottom bellows the smallest horizontally. The three bellows are so made that they do not "squarely" overlap one another or the outermost ridges of the bellows and the innermost ridges of the bellows do not vertically overlap their corresponding outermost or innermost ridges of the other bellows. Therefore, the "dead space" created by the overlapping innermost ridges of the bellows can be made small. The bellows container is also provided with a neck portion having an opening for charging and discharging a fluid, a reversible bottom protrusion, a top shoulder section and a reversible bottom "shoulder" section.

The small "dead space" in the fully contracted bellows container will be effectively eliminated by the reversed bottom protrusion and bottom shoulder section.

Such three large bellows can be made such that the middle bellows is the largest to achieve the same purpose and effect.

Another plastic bellows container according to the present invention comprises bellows, a top neck portion with an opening for charging and discharging a fluid, a reversible bottom protrusion, a top shoulder section and a reversible bottom shoulder section, in which the bellows sideway protrusions or "wings" are somewhat "shorter", or the innermost ridges of the bellows are not "close" to the axis of the bellows container.

The "dead space" to be produced in the fully contracted bellows container and the space in the neck portion are effectively eliminated by the reversed bottom shoulder section and the reversed bottom protrusion when both the bottom shoulder section and the bottom protrusion are pushed into the bellows container and the neck portion.

Another plastic bellows container according to the present invention comprises three bellows chambers, a top bellows chamber, a middle bellows chamber and a bottom bellows chamber, each comprising three bellows which are different in size as previously described. The bottom of the top bellows chamber having a neck portion with an opening is provided with a reversible bottom shoulder section as described earlier. The top of the middle bellows chamber is provided with a reversible top shoulder section. And the bottom of the bottom bellows chamber having a reversible bottom protrusion is provided with a reversible bottom shoulder section.

When the whole bellows container is fully contracted, the corresponding outermost ridges and innermost ridges of the bellows do not overlap one on another squarely or vertically, making the "dead space" in the fully contracted bellows container small.

The "small dead space" in the fully contracted bellows container and the top neck portion is effectively eliminated by the reversed bottom shoulder section of the top bellows chamber, the reversed top shoulder section of the middle bellows chamber, the reversed bottom shoulder section of the bottom bellows chamber and the reversed bottom protrusion.

Another plastic bellows container according to the present invention is similar in appearance to a conventional plastic bellows container having a number of bellows along its side wall, in which the bellows container is provided with a depressible neck portion having an opening and a reversible top shoulder section. The neck portion can be partially pushed into the bellows container or buried as the top shoulder section is pushed into the bellows container (without getting reversed). The half buried neck portion and the reversed top shoulder section effectively eliminate the space or "dead space" produced by the overlapping bellows in the fully contracted bellows container.

Such a plastic bellows container can be provided with a taper such that the space or "dead space" may be made even smaller, in which the reversible top shoulder section is made to effectively fill the truncated cone space produced in the fully contracted bellows container.

A reversible shoulder section of the same purpose and function can be provided on the bottom of the plastic bellows container, instead of the top of the bellows container.

A plastic bellows container according to the present invention may be produced in many other designs while providing the features of the present invention. A plastic bellows container of the present invention may be used in a plastic or metal container holder, which may be repeatedly used by just replacing the bellows container when it is emptied with a new bellows container filled with a fluid.

A plastic bellows container of the present invention may be provided with a valve in the neck portion that prevents inflow or flow back of the content and air into the bellows container in order to keep the content fresh and without deterioration by air and contamination. A plastic bellows container of the present invention may be used with a discharging means such as a discharge nozzle, spray gun, airless pump, or discharge amount-control device. A plastic bellows container of the present invention can be further provided with an air tightening device or means to prevent air inflow to keep the fluid content fresh and without deterioration. All such accessories can be repeatedly used.

These and other objects and features of the present invention will be more fully understood from the following detailed description which should be read in light of the accompanying drawings in which corresponding reference numerals refer to corresponding parts throughout the several views.

BRIEF DESCRIPTION OF THE DRAWINGS

Throughout the figures, the right sides are sectional views.

FIG. 1(*b*) is a side view of the plastic bellows container of FIG. 1(*a*) showing when the plastic bellows container is fully contracted.

FIG. 2(*b*) is a side view of the plastic bellows container of FIG. 2(*a*) showing when the plastic bellows container is fully contracted.

FIG. 3(*b*) is a side view of the plastic bellows container of FIG. 3(*a*) showing when the plastic bellows container is fully contracted.

FIG. 4(*b*) is a side view of the plastic bellows container of FIG. 4(*a*) showing when the plastic bellows container is fully contracted.

FIG. 5(*b*) is a side view of the plastic bellows container of FIG. 5(*a*) showing when the plastic bellows container is fully contracted.

FIG. 6(*b*) is a side view of the plastic bellows container of FIG. 6(*a*) showing when the plastic bellows container is fully contracted.

FIG. 6(*b'*) is a side view of the plastic bellows container of FIG. 6(*a'*) showing when the plastic bellows container is fully contracted.

FIG. 7(*b*) is a side view of the plastic bellows container of FIG. 7(*a*) showing when the plastic bellows container is fully contracted.

FIG. 7(*b'*) is a side view of the plastic bellows container of FIG. 7(*a'*) showing when the plastic bellows container is fully contracted FIG. 8(*a*) is a side view of a plastic bellows container according to another embodiment of the present invention.

FIG. 8(*a'*) is a side view of a plastic bellows container according to another embodiment of the present invention.

DETAILED DESCRIPTION OF THE PREFERRED EMBODIMENT

Plastic bellows containers of the present invention are containers that are used to contain a viscous fluid including gel and paste, such as a viscous food product, cosmetic product, pharmaceutical product or oil, which is discharged from plastic bellows containers as the bellows containers are contracted vertically.

Plastic bellows containers according to the present invention can be produced in a simple single blow molding process of a plastic material, therefore all plastic bellows containers of the present invention can be produced cheaply.

Figure 1B:
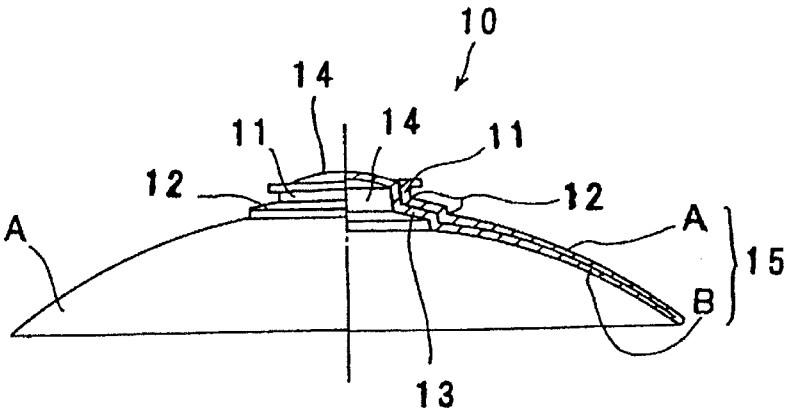
FIG. 1(*a*) is a side view of a plastic bellows container according to an embodiment of the present invention.
Figure 1A:
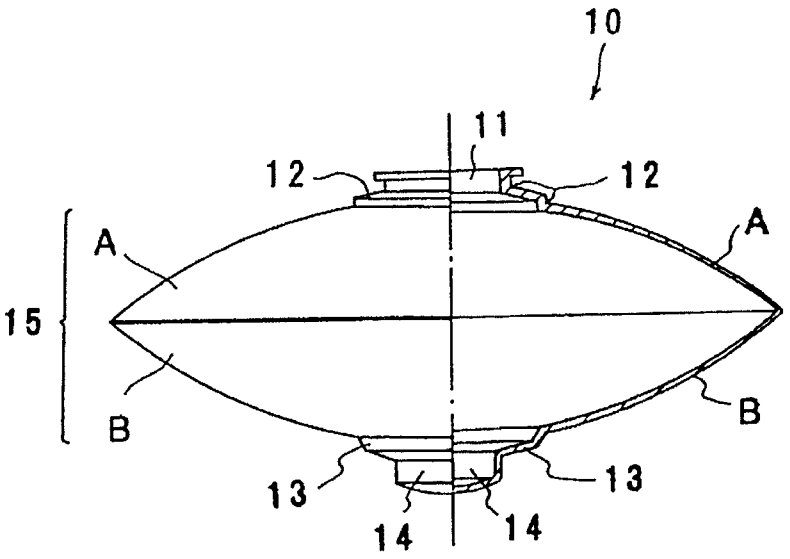

In FIGS. 1(*a*) and 1(*b*), a plastic bellows container according to an embodiment of the present invention is shown. This bellows container 10 has a single bellows 15 which defines its side wall. As can be seen in the figures, the bellows 15 is made thinner toward its outermost ridge, which is usual with any plastic bellows container and also true throughout the embodiments of the present invention.

In FIG. 1(*a*), the bellows container 10 is provided with a neck portion 11 on the top and a reversible bottom protrusion 14 on the bottom which protrudes out from the bottom of the bellows container 10. The neck portion 11 has an opening through which a viscous fluid is charged and discharged. The configuration of the reversible bottom protrusion 14 is so made that when the bottom protrusion 14 is reversed or fully pushed into the bellows container 10, the inner space of the neck portion 12 is substantially filled with the reversed bottom protrusion 14. The bellows container 10 is also provided with a top shoulder section 12 at the bottom of the neck portion 11, and a reversible bottom shoulder (or foot) section 13 at the bottom of the bottom protrusion 14.

In FIG. 1(*b*) is shown the fully contracted bellows container 10. As can be seen in the figure, the upper portion A of the bellows 15 and the lower portion B of the bellows 15 substantially completely contact each other, leaving substantially no void therebetween. The bottom protrusion 14 and the bottom shoulder section 13 are reversed or pushed into the bellows container 10 and substantially completely fill the inner space of the neck portion 11 and the top shoulder section 12. Thus, vertually no dead space is generated in the fully contracted bellows container 10. Therefore, substantially all the viscous fluid content in the bellows container 10 can be effectively discharged.

A single-bellows plastic container can comprise without the top shoulder section 12 and the corresponding bottom shoulder section 13 since the overlapping innermost ridges of the bellows of such a single-bellows plastic container do not create "dead space" to be eliminated. However, it is advantageous to provide a top shoulder section 12 and a bottom shoulder section 13 to even a single-bellows plastic container because such shoulder sections can reinforce the neck portion and the bottom protrusion, provide easier reversing of the bottom protrusion, and facilitate easier charging of the bellows container with a highly viscous fluid.

A single-bellows plastic container will still properly function even without a reversible bottom protrusion. That is, a single-bellows plastic container can comprise only a top neck portion with an opening and a single bellows defining its side wall and bottom. It is preferred that the neck portion of such a single-bellows plastic container is provided with a discharging means such as an airtight spray gun. The space left in the neck portion when the plastic container is fully contracted is eliminated by the discharging means.

Througout the embodiments shown in FIGS. 1(*a*)–5(*b*), the upper portions of the bellows may be pressed in instead of the lower portions of the bellows. In such cases, the appearances of the FIGS. 1(*b*)–5(*b*) will be provided "very roughly" reversed.

Figure 2B:
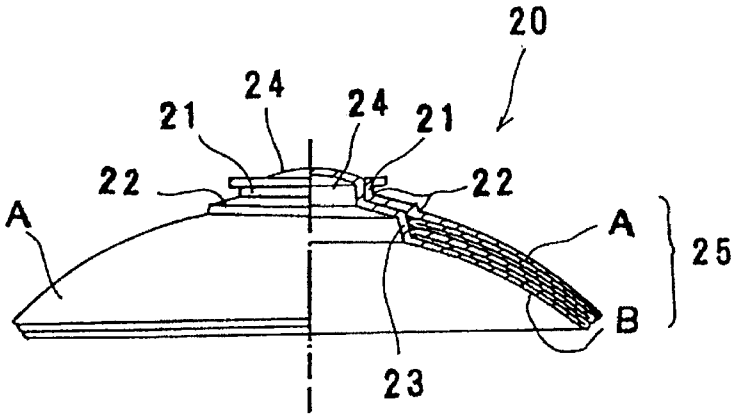
FIG. 2(*a*) is a side view of a plastic bellows container according to another embodiment of the present invention.
Figure 2A:
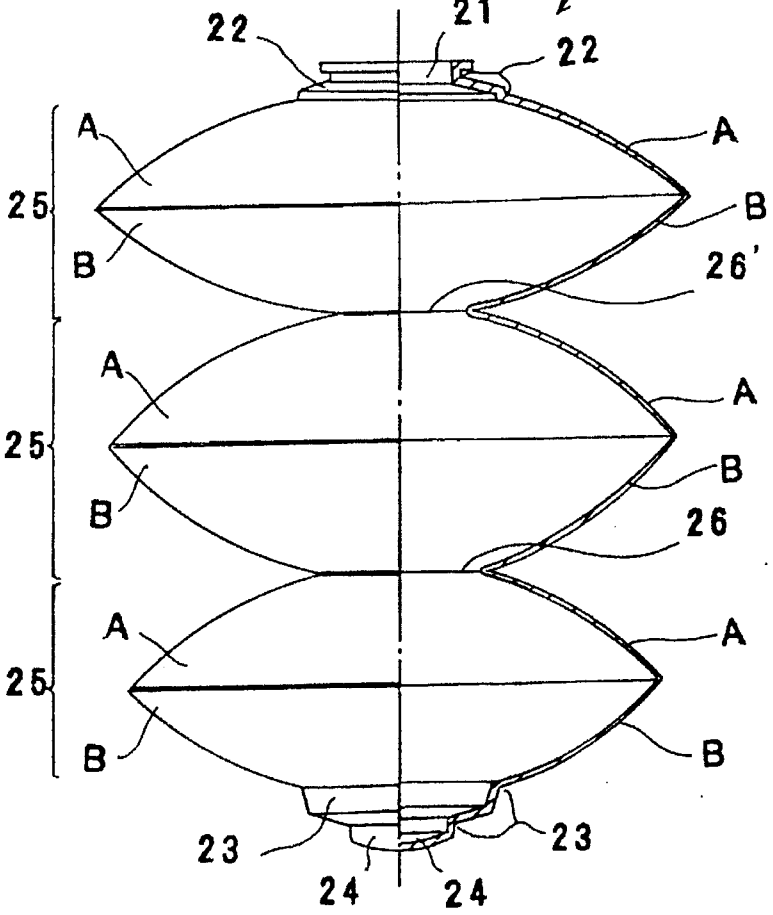

In FIGS. 2(*a*) and 2(*b*), a plastic bellows container 20 according to another embodiment of the present invention is shown. The bellows container 20 comprises three bellows chambers 25 connected by openings 26 and 26', a neck portion 21 with an opening for charging and discharging a fluid, a reversible bottom protrusion 24, a top shoulder section 22 and a reversible bottom shoulder section 23. The relationship in configuration between the top neck portion 21 and the reversible bottom protrusion 24 is as described earlier. The opening 26 is made slightly larger than the opening 26'. The top bellows chamber 25 is made slightly larger than the middle bellows chamber 25, which is slightly larger than the bottom bellows chamber 25. Thus, as shown in FIG. 2(*b*), when the bellows container 20 is fully contracted, the overlapping innermost ridges of the bellows 25 do not generate as large space as otherwise (when the innermost ridges overlap vertically).

As shown in FIG. 2(*b*), the upper portions A and the lower portions B of the bellows 25 come substantially completely in contact when the bellows container 20 is fully contracted leaving substantially no void therebetween. The bottom protrusion 24 and the bottom shoulder section 23 are reversed and fill the space in the fully contracted bellows container 20 and the inner space of the neck portion 21. Thus, substantially no dead space is left in the fully contracted bellows container 20.

Figure 3B:
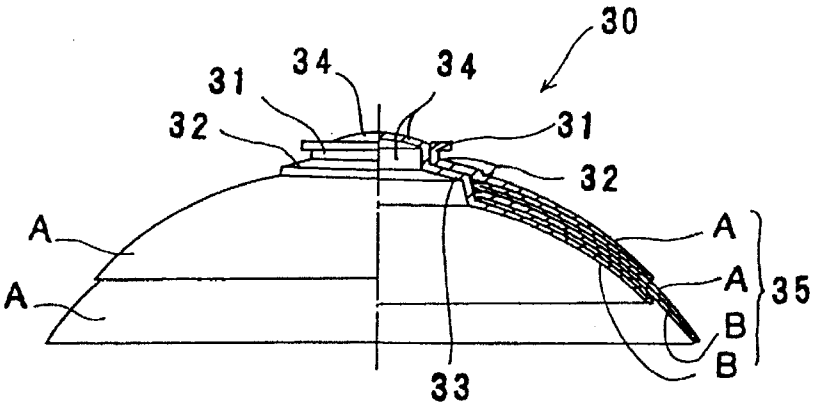
FIG. 3(*a*)is a side view of a plastic bellows container according to another embodiment of the present invention.
Figure 3A:
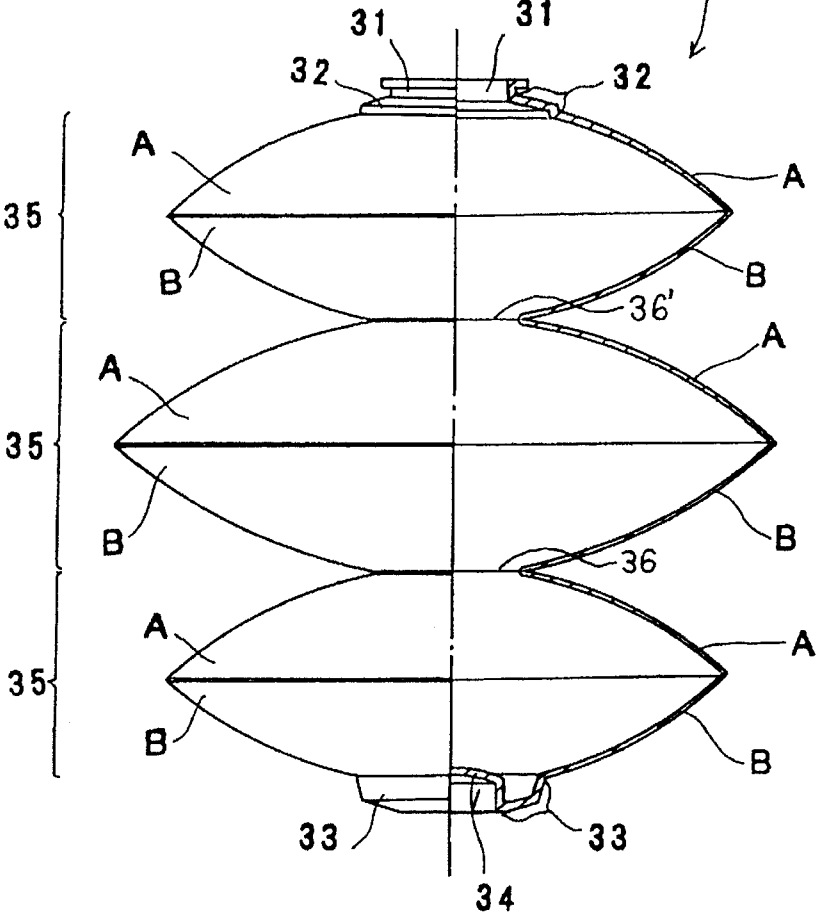

FIGS. 3(*a*) and 3(*b*) show a plastic bellows container 30 according to another embodiment of the present invention. The bellows container 30 comprises three bellows chambers 35 connected by two openings 36 and 36', a neck portion 31 with an opening for charging and discharging a fluid, a reversed bottom protrusion 34, a top shoulder section 32 and a reversible bottom shoulder section 33. In this embodiment, the opening 36 is made slightly larger than the opening 36'.

The top bellows chamber 35 is made slightly smaller horizontally than the middle bellows chamber 35, and the bottom bellows chamber 35 is made slightly smaller horizontally than the middle bellows chamber 35. The bottom protrusion 34 is formed reversely protruding into the bellows container 30, as shown in FIG. 3(*a*). The reversed protrusion 34 is so formed that when the bellows container 30 is fully contracted the reversed protrusion 34 fits the inside of the neck portion 31.

As is shown in FIG. 3(*b*), when the bellows container 30 is fully contracted, the (originally) reversed bottom protrusion 34 and the reversed bottom shoulder section 33 effectively fill the inside of the neck portion 31 and the top shoulder section 32, leaving substantially no dead space in the fully contracted bellows container 30.

Figure 4B:
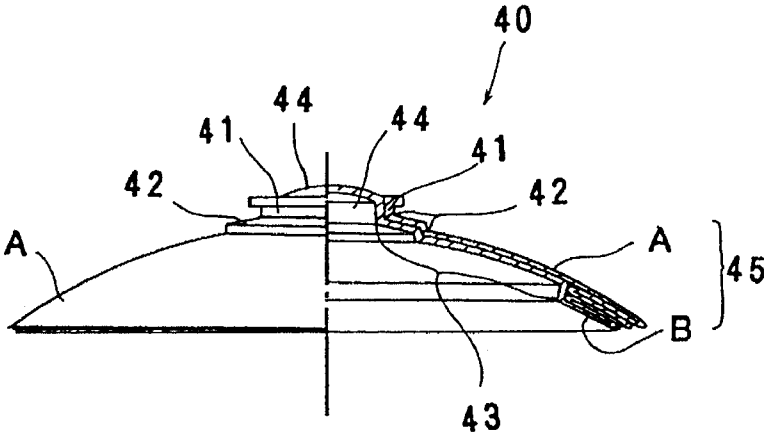
FIG. 4(*a*) is a side view of a plastic bellows container according to another embodiment of the present invention.
Figure 4A:
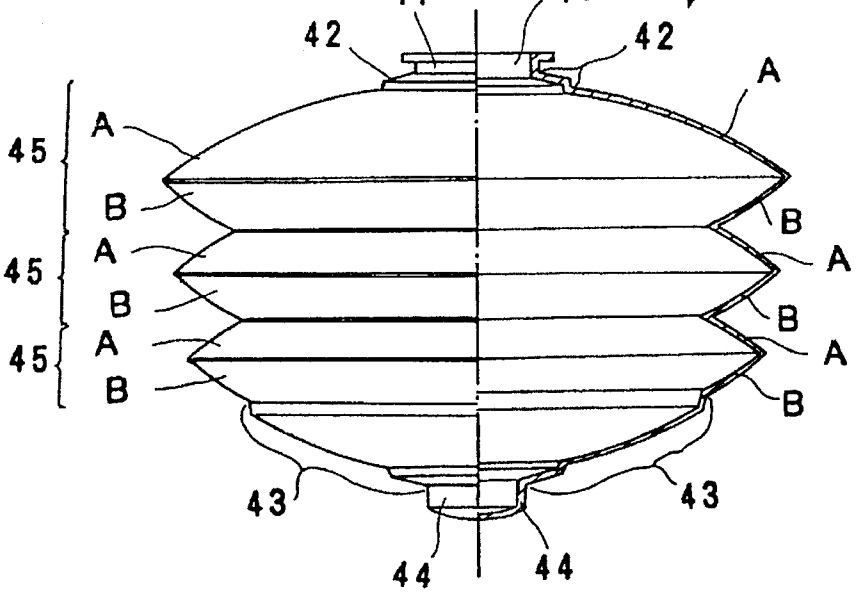

FIGS. 4(*a*) and 4(*b*) show a plastic bellows container 40 according to another embodiment of the present invention. The bellows container 40 has three bellows 45, the top bellows 45 being slightly larger horizontally than the middle bellows 45, and the middle bellows 45 slightly larger horizontally than the bottom bellows 45.

In this embodiment, the openings connecting the three bellows chambers are made large such that the lower portion B of the top bellows 45, the upper portion A and the lower portion B of the middle bellows 45, and the upper portion A of the bottom bellows 45 are short.

The bellows container 40 is also provided with a top neck portion 41 having an opening through which a fluid is charged and discharged, a reversible bottom protrusion 44, a top shoulder section 42 and a reversible wide bottom shoulder section 43. The wide bottom shoulder section 43 is so made that when reversed it contacts the upper portion A of the top bellows 45 (though partially) and the top shoulder section 42, leaving practically no void therebetween.

As shown in FIG. 4(*b*), when the bellows container 40 is fully contracted, the reversed bottom protrusion 44 fills the inside of the neck portion 41, and the reversed bottom shoulder section 43 fills the inside of the top shoulder section 42 (also contacting a portion of the bellows side wall 45), effectively eliminating "dead space" in the fully contracted bellows container 40.

Figure 5B:
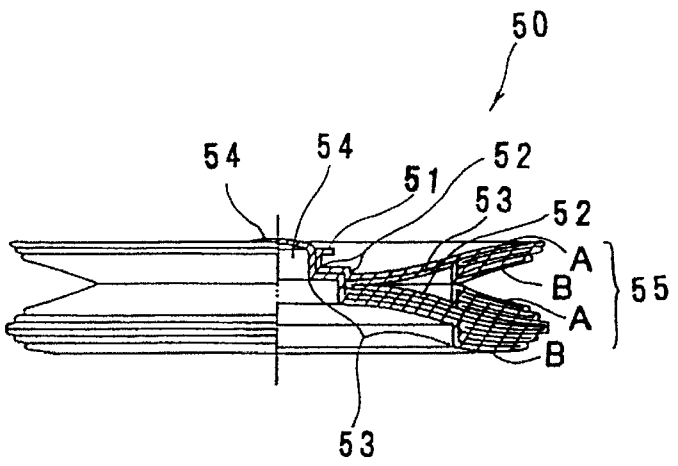
FIG. 5(*a*) is a side view of a plastic bellows container according to another embodiment of the present invention.
Figure 5A:
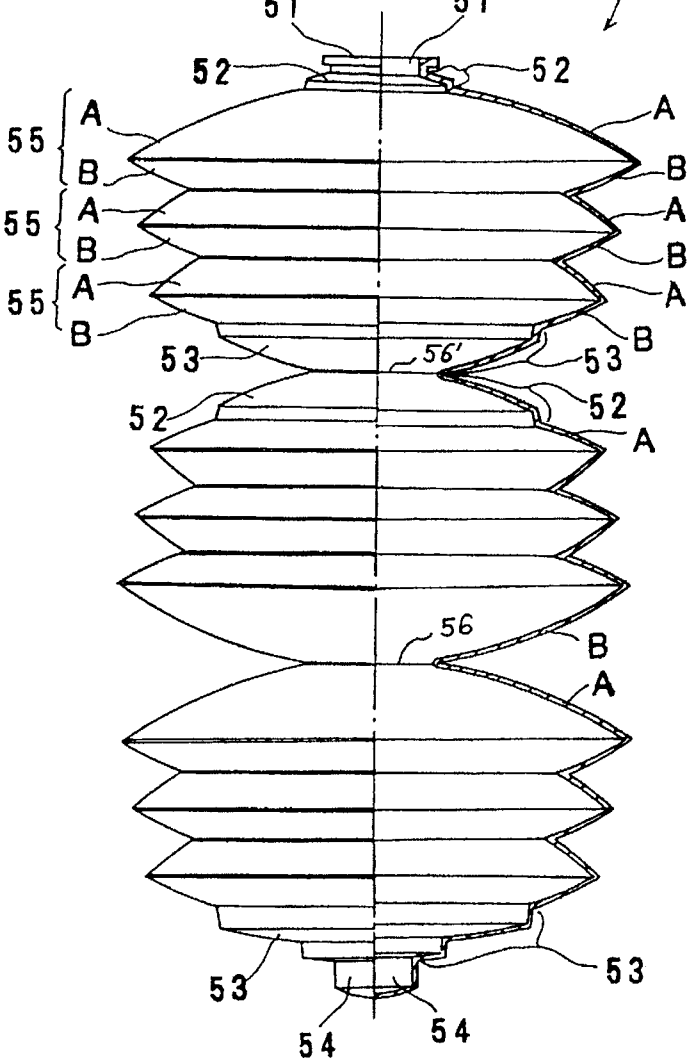
Figure 6A:
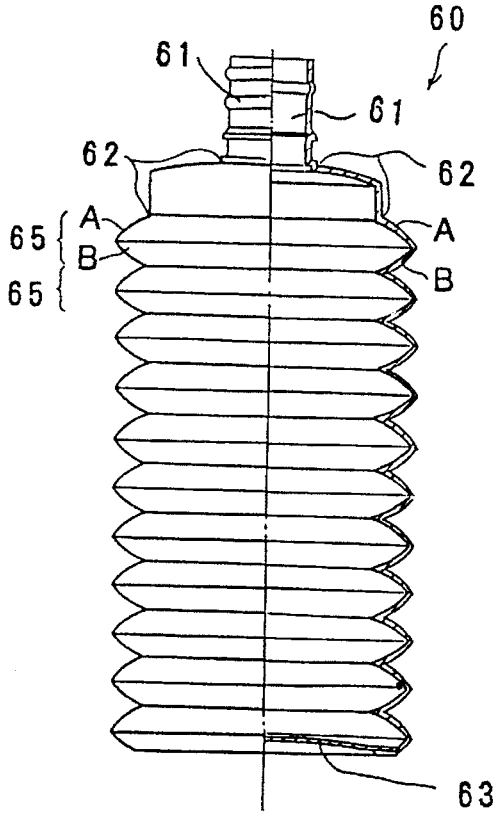
FIG. 6(*a*) is a side view of a plastic bellows container according to another embodiment of the present invention.
Figure 6B:
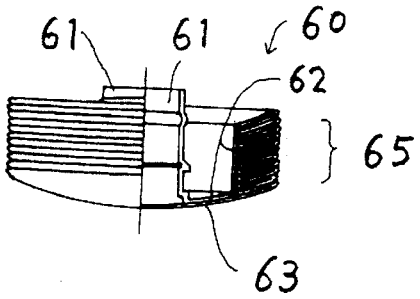
Figure 6B:
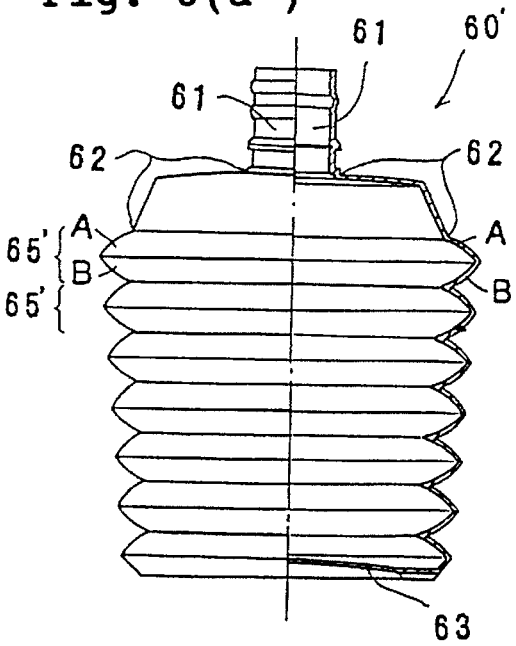
Figure 6B:
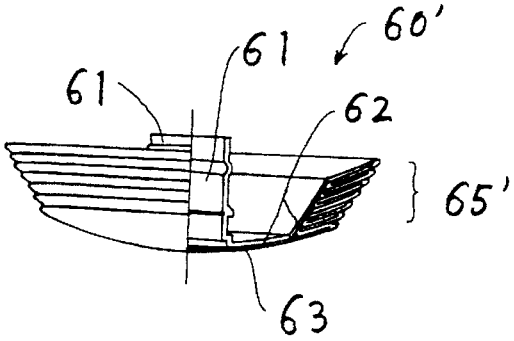
Figure 7A:
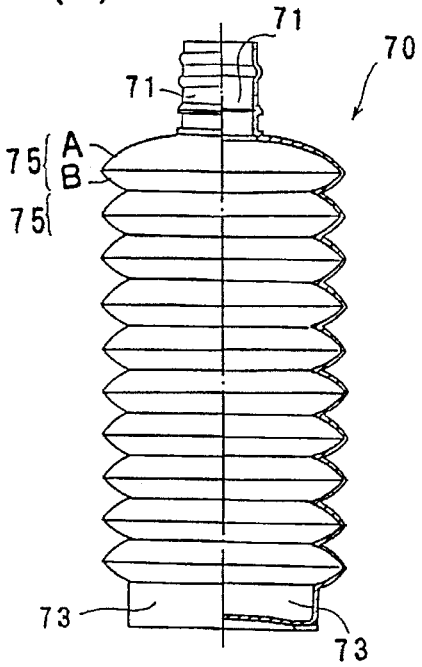
FIG. 7(*a*) is a side view of a plastic bellows container according to another embodiment of the present invention.
Figure 7B:
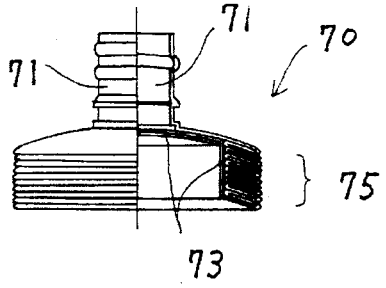
Figure 7B:
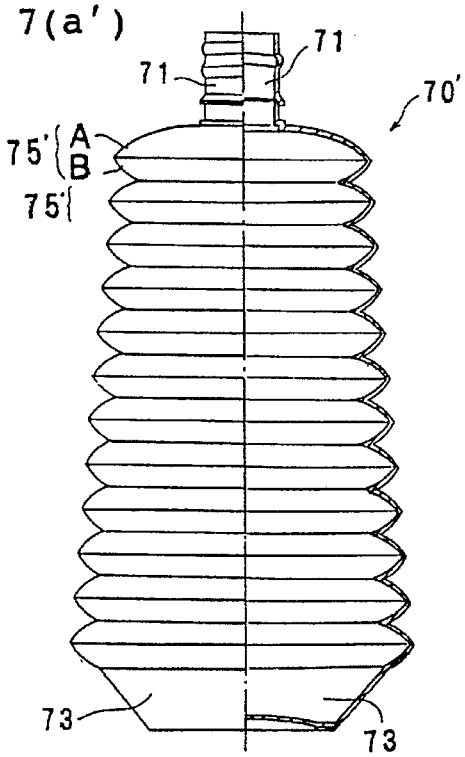
Figure 7B:
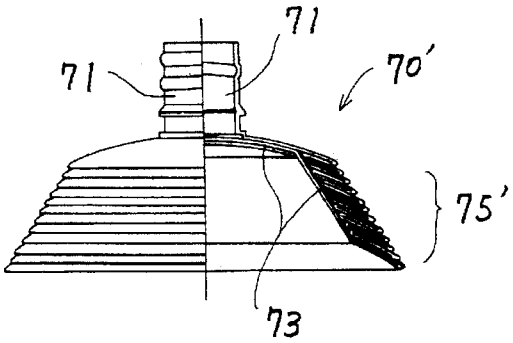
Figure 8A:
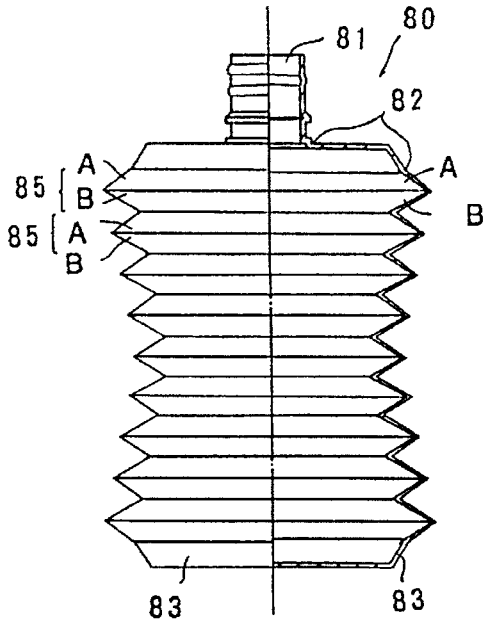
FIG. 8(*b*) is a side view of the plastic bellows container of FIG. 8(*a*) showing when the plastic bellows container is fully contracted.
Figure 8B:
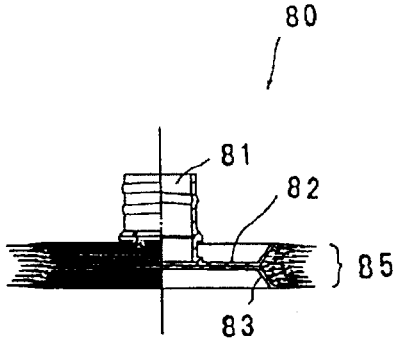
Figure 8B:
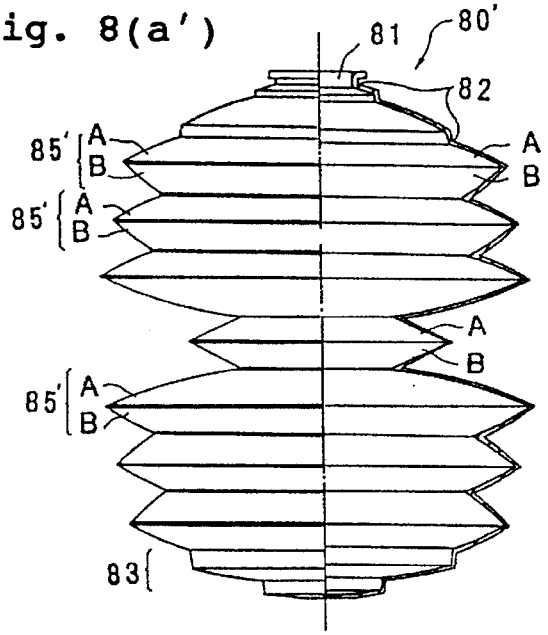
Figure 8B:
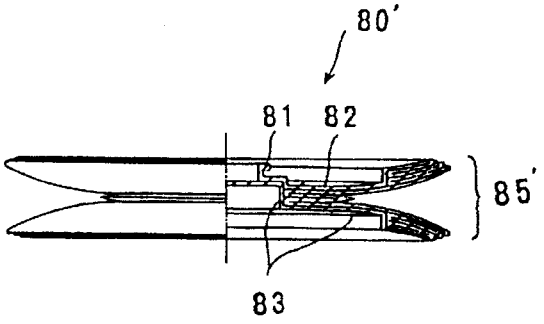

In FIGS. 5(*a*) and 5(*b*), a plastic bellows container 50 according to another embodiment of the present invention is shown. This bellows container 50 comprises three bellows chambers connected with two openings 56 and 56'. Each bellows chamber has three differently sized bellows 55 as shown in FIG. 5(*a*). On the top bellows chamber are provided a top neck portion 51 having an opening for charging and discharging a fluid and a top shoulder section 52. On the bottom of the top bellows chamber is provided a reversible bottom shoulder section 53. On the top of the middle bellows chamber is provided a reversible top shoulder section 52. On the bottom of the bottom bellows chamber are provided a reversible bottom shoulder section 53 and a reversible bottom protrusion 54.

As shown in FIG. 5(*b*), when the bellows container 50 is fully contracted, the reversed bottom protrusion 54 enters inside of the top neck portion 51; the inside of the top shoulder section 52 at the bottom of the neck portion 51 is filled with the reversed bottom shoulder section 53 at the bottom of the reversible bottom protrusion; and the bottom shoulder section 53 on the top bellows chamber and the top shoulder section 52 on the middle bellows chamber are reversed, cooperatively and effectively eliminating "dead space" in the fully contracted plastic bellows container 50.

The plastic bellows container 60 shown in FIGS. 6(*a*) and 6(*b*) has an appearance of a conventional plastic bellows container. However, the bellows container 60 is unique in that the bellows container 60 is provided with a reversible top shoulder section 62 and a depressible (not reversible) top neck portion 61 having an opening for charging and discharging a fluid. The neck portion 61 is partially depressed and the top shoulder section 62 is pushed into the bellows container 60 together with the neck portion 61 when the bellows container 60 is fully contracted, and they together eliminate "dead space" in the fully contracted bellows container 60, as shown in FIG. 6(*b*).

The plastic bellows container 60 is to be provided with a discharging means (not shown) such as an airless gun or airless pump in the neck portion 61. Therefore, the space left inside the neck portion 61 is eliminated by the discharging means.

The plastic bellows container 60' shown in FIGS. 6(*a'*) and 6(*b'*) is slightly different from the bellows container 60 in that the bellows side wall is tapered such that the space to be created in the fully contracted bellows container 60' may be smaller. The configuration of the top shoulder section 62 is also slightly modified such that when the neck portion 61 is partially depressed and the top shoulder section 62 is reversed, they can effectively eliminate the reversed truncated cone space generated inside the fully contracted bellows container 60'.

The plastic bellows container 60' is also to be provided with a discharging means (not shown) on the neck portion 61. Therefore, the space left inside the neck portion 60 is eliminated by the discharging means.

FIGS. 7(*a*) and 7(*b*) show a plastic bellows container 70 according to another embodiment of the present invention. The bellows container 70 has a reversible bottom shoulder section 73 instead of the reversible top shoulder section 62 of the bellows container 60. In this embodiment, the top neck portion 71 having an opening for charging and discharging a fluid is not made depressible.

The bottom shoulder section 73 is pushed into the bellows container 70 when the bellows container 70 is fully contracted, and effectively eliminates "dead space" in the fully contracted bellows container 70.

The plastic bellows container 70 is also to be provided with a discharging means (not shown). The space inside the neck portion 71 is eliminated by the discharging means.

The plastic bellows container 70' in FIGS. 7(*a'*) and 7(*b'*) has a tapered bellows side wall. Therefore, the space created in the bellows container 70' when the bellows container 70' is fully contracted has a truncated cone shape. The reversible bottom protrusion 73 is so formed that it substantially fits the truncated cone space effectively when the bottom protrusion 73 is reversed.

The plastic bellows container 70' is also to be provided with a discharging means (not shown). Therefore, the space inside the neck portion 71 is eliminated.

FIGS. 8(*a*) and 8(*b*) show another plastic bellows container 80. The bellows container 80 is provided with both a reversible top shoulder section 82 and a reversible bottom shoulder section 83. The top neck portion 81 provided on the bellows container 80 is partially depressible (not reversible). When the bellows container 80 is fully contracted, the neck portion 81 having an opening for charging and discharging a fluid is partially depressed or buried in the bellows container 80 together with the top shoulder section 82, and the top shoulder section 82 and the bottom shoulder section 83 are reversed, effectively and cooperatively eliminating "dead space" in the fully contracted bellows container 80, as shown in FIG. 8(*b*).

The plastic bellows container 80 is also to be provided with a discharging means (not shown) in the neck portion 81. Therefore, the space in the neck portion 81 is eliminated by the discharging means.

The plastic bellows container 80' shown in FIGS. 8(*a'*) and 8(*b'*) is a somewhat modified version of the bellows container 80. The bellows container 80' is provided with a top bellows chamber, a bottom bellows chamber and a small middle bellows chamber therebetween. The top bellows chamber provided on the bellows container 80' has three bellows, each different in size, and the bottom bellows chamber is provided with three bellows, each different in size. The small middle chamber is provided with a single bellows. The top bellows chamber has a reversible top shoulder section 82, and the bottom bellows chamber has a reversible bottom shoulder section 83. The neck portion 81 having an opening for charging and discharging a fluid is depressible and the bottom protrusion 84 is reversible.

When the bellows container 80' is fully contracted, the top neck portion 81 is fully depressed into the bellows container 80', the bottom protrusion 84 is reversed, the top shoulder section 82 is reversed, and the bottom shoulder section 83 is reversed, effectively and cooperatively eliminating "dead space" in the fully contracted bellows container 80', as shown in FIG. 8(b').

The plastic bellows container 80' is also to be provided with a discharging means (not shown) in the neck portion 81. The space in the neck portion 81 is therefore eliminated by the discharging means.

Thus described, plastic bellows containers according to the present invention, while they can be produced cheaply, can effectively and practically eliminate "dead space" in the fully contracted bellows containers, therefore the viscous fluid contents are not wasted.

Bellows containers according to the present invention may be made circular or polygonal in horizontal sectional configuration such as triangular, square, pentagonal, hexagonal or octagonal. The shape of bellows side walls may take various configurations as desired, provided that the features of the present invention are effectively incorporated. It is preferred that, as shown, see for example FIGS. 2(*a*) and 2(*b*), the bellows side walls include upper or top and lower or bottom bellows section walls A and B respectively, both of convex configuration to form a space therebetween when the bellows section is in an expanded position, FIG. 2(*a*). When the bellows section is in a contracted position, one of the bellows section walls, the lower wall B in FIG. 2(*b*), moves to a concave configuration against the other bellows section wall to assume a substantially stable position which eliminates the space between the bellows walls.

The upper opening of the top neck portion of a bellows container according to the present invention may be sealed after charging of the bellows container with a viscous fluid with an appropriate sealing means such as a paper seal, resin seal or metal seal to keep the content fresh and without deterioration by air and contamination. A valve may be provided in the neck portion to prevent air from entering the bellows container as well as prevent return of the fluid content hanging out of the neck portion into the bellows container.

Various types of fluid dischargers or discharging means may be selectively provided on the top neck portion as desired. They may be removable and reusable. A plastic bellows container of the present invention may be used in a container holder with an appropriate fluid dispensing means. Such a holder with a dispensing means may be removable and reusable.

Plastic materials which can be used to produce bellows containers according to the present invention can be any suitable resin material in accordance with their use, including resins of polyethylene, polypropylene, polyvinyl chloride, polyester, polyvinyl alcohol, fatty acid polyester, polyglycol acid and poly lactate.

While the foregoing invention has been described with reference to its preferred embodiments, various modifications and alterations will occur to those skilled in the art. Those variations and modifications are intended to fall within the scope of the appended claims.

What is claimed is:

1. A contractible plastic bellows container comprising:

a bellows wall including top and bottom end portions;

a neck portion extending from one of the top or bottom end portions and having an opening through which a viscous fluid may be charged and discharged;

a first reversible section formed in at least one of said top or bottom end portions, said first reversible section having a first position wherein the volume of the bellows container is greater than the volume of the bellows container when the first reversible section is in a reversed second position, and wherein the first reversible section in its second position substantially reduces waste space within the container when the bellows wall is in a contracted position; and a second reversible section formed in the first reversible section said second reversible section having a first position wherein the volume of the bellows container is greater than the volume of the bellows container when the second reversible section is in a reversed second position, and wherein the second reversible section in its second position while the first reversible section is also in its second position and the bellows wall is contracted extends into the neck portion to substantially reduce the waste space within the neck portion.

2. A contractible plastic bellows container according to claim 1, wherein the neck portion extends from the top end portion, wherein the second reversible section is a reversible bottom protrusion extending from the first reversible section, and wherein said reversible bottom protrusion is so formed as to substantially completely fit inside of said neck portion when said contractible plastic bellows container is fully contracted and the first reversible section and said reversible bottom protrusion are in their reversed second positions, substantially completely eliminating the waste space in the fully contracted plastic bellows container.

3. A contractible plastic bellows container according to claim 1, wherein the neck portion extends from the top end portion, wherein the top end portion additionally includes a top shoulder section connected with and from which said neck portion extends, wherein the second reversible section is a reversible bottom protrusion extending from the bottom end portion, wherein the bottom end portion additionally includes a reversible bottom shoulder section connected with and from which said bottom protrusion extends and which forms the first reversible section, and wherein said reversible bottom shoulder section is so formed as to substantially completely fit inside of said top shoulder section when said contractible plastic bellows container is fully contracted and said reversible bottom shoulder section is reversed, substantially reducing the waste space in the fully contracted plastic bellows container.

4. A contractible plastic bellows container according to claim 1, wherein the first reversible section is a reversible bottom shoulder section on the bottom end portion.

5. A contractible plastic bellows container according to claim 4, wherein said bottom shoulder section includes a protrusion projecting into the container so that when the bottom shoulder section is in its second position and the contractible plastic bellows container is fully contracted, said protrusion fits inside the neck portion, said bottom shoulder and said protrusion substantially completely eliminating the waste space in the fully contracted plastic bellows container.

6. A contractible plastic bellows container according to claim 1, including a shoulder section surrounding the neck portion and from which the neck portion extends, the first reversible section fitting within the container and the shoulder section when the container is fully contracted and the first reversible section is in its second position.

7. A contractible plastic bellows container according to claim 1, additionally including a third reversible section in an end portion, said third reversible section having a first position wherein the volume of the bellows container is greater than the volume of the bellows container when the third reversible section is in a second position, the reversible section, the second reversible section, and the third reversible section when in their second positions cooperating to reduce waste space in the container when the bellows is in a contracted position.

8. A contractible plastic bellows container according to claim 7, wherein the second reversible section extends from the bottom end portion and forms a bottom protrusion, the first reversible section extends from the bottom end portion and forms a bottom shoulder section concentric with and greater in diameter than the bottom protrusion, and the third reversible section extends from the top end portion and forms a top shoulder section.

9. A contractible plastic bellows container according to claim 1, wherein the bellows wall includes at least one contractible bellows section having top and bottom bellows section walls, each of said top and bottom bellows section walls being of convex configuration with a space therebetween when the bellows is in an expanded position whereby when the bellows section is in a contacted position one of the bellows section walls moves to a concave configuration against the other bellows section wall to assume a substantially stable position which eliminates the space therebetween.

10. A contractible plastic bellows container comprising:

a bellows wall including top and bottom end portions and at least one contractible bellows section having top and bottom bellows section walls, each of said top and bottom bellows section walls being of convex configuration with a space therebetween when the bellows is in an expanded position whereby when the bellows section is in a contacted position one of the bellows section walls moves to a concave configuration against the other bellows section wall to assume a substantially stable position which eliminates the space therebetween;

a neck portion extending from one of the top or bottom end portions and having an opening through which a viscous fluid may be charged and discharged; and a reversible section formed in at least one of said top or bottom end portions, said reversible section having a first position wherein the volume of the bellows container is greater than the volume of the bellows container when the reversible section is in a reversed second position, and wherein the reversible section in its second position substantially reduces waste space within the container when the bellows wall is in a contracted position.

11. A contractible plastic bellows container according to claim 10, additionally including a second reversible section in an end portion, said second reversible section having a first position wherein the volume of the bellows container is greater than the volume of the bellows container when the second reversible section is in a second position, the reversible section and the second reversible section when in their second positions cooperating to reduce the waste space in the container when the bellows is in a contracted position.

12. A contractible plastic bellows container according to claim 10, wherein said top end portion further includes at least one reversible top shoulder section having a first position wherein the volume of the bellows container is greater than the volume of the bellows container when the at least one reversible top shoulder section is in a second position, and wherein said reversible section is at least one reversible bottom shoulder section in said bottom end portion, said at least one reversible top shoulder section and said at least one reversible bottom shoulder section cooperating when in the second positions to substantially eliminate waste space in the fully contracted plastic bellows container.

13. A contractible plastic bellows container according to claim 10, wherein the reversible section is a reversible top shoulder section in the top end portion with the neck portion extending therefrom and depressible to move the top shoulder section to its second position to substantially reduce waste space in the fully contracted plastic bellows container.

14. A contractible plastic bellows container according to claim 10, wherein said bottom end portion additionally includes a reversible bottom shoulder section having a first position wherein the volume of the bellows container is greater than the volume of the bellows container when the reversible bottom shoulder section is in a second position and cooperable with said top shoulder section when both are in their second positions to substantially eliminate waste space in the fully contracted plastic bellows container.

* * * * *